US006802348B2

(12) United States Patent
Vernon et al.

(10) Patent No.: US 6,802,348 B2
(45) Date of Patent: Oct. 12, 2004

(54) BOOK BAG

(75) Inventors: Mitzi R. Vernon, Christiansburg, VA (US); Tanya Blasko, Blacksburg, VA (US)

(73) Assignee: Virginia Tech Intellectual Properties, Blacksburg, VA (US)

( * ) Notice: Subject to any disclaimer, the term of this patent is extended or adjusted under 35 U.S.C. 154(b) by 0 days.

(21) Appl. No.: 10/252,725

(22) Filed: Sep. 24, 2002

(65) Prior Publication Data

US 2003/0047579 A1 Mar. 13, 2003

Related U.S. Application Data

(63) Continuation of application No. 29/147,238, filed on Aug. 27, 2001.

(51) Int. Cl.[7] ..... A45C 1/08

(52) U.S. Cl. ..... 150/111; 150/148; 150/152; 150/145; 206/311

(58) Field of Search ..... 190/902, 903, 190/110, 901; 150/111, 149, 148, 152, 145, 113; 206/311, 425; 383/105; 281/13, 29; 402/79

(56) References Cited

U.S. PATENT DOCUMENTS 2,764,201 A * 9/1956 Whippo ..... 150/111
2,803,281 A * 8/1957 Sutton ..... 150/145
D183,711 S * 10/1958 Blaivas ..... D3/233
D302,211 S * 7/1989 Sears ..... D3/283
5,105,338 A * 4/1992 Held ..... 190/109 X
5,139,143 A * 8/1992 Pond ..... 206/373
5,350,045 A * 9/1994 Roberson ..... 190/111
D362,751 S * 10/1995 Kopel ..... D3/233
5,829,502 A * 11/1998 Distefano et al. ..... 150/113
5,916,280 A * 6/1999 Lantz ..... 70/68
5,947,279 A * 9/1999 Lee et al. ..... 206/232
5,954,170 A * 9/1999 Chisholm ..... 190/109
6,168,340 B1 * 1/2001 Lehmann et al. ..... 402/79
D437,172 S * 2/2001 Hillman ..... D6/633
6,244,400 B1 * 6/2001 Bowers ..... 190/110

* cited by examiner

*Primary Examiner*—Tri M. Mai
*Assistant Examiner*—B. Ross
(74) *Attorney, Agent, or Firm*—McGuireWoods LLP

(57) ABSTRACT

A book bag for easy carrying and accessing includes a detachable wallet styled book assembly. The wallet has multiple pages with transparent sleeves so that information can be presented much as a conventional book. This book bag permits a particular subject area to be collated and presented as a book within a book bag. The book does not require removal from the book bag. The detachable wallet can be quickly and conveniently replaced with another so that updating new study material for students or others can be easily performed.

15 Claims, 5 Drawing Sheets

BOOK BAG

CROSS REFERENCE TO RELATED APPLICATIONS

This application is a continuation application of U.S. design patent application Ser. No. 29/147,238 filed Aug. 27, 2001, incorporated herein by reference in its entirety.

DESCRIPTION

This invention was made with government support under Contract Number HRD-9979287 awarded by the National Science Foundation. The government has certain rights in the invention.

BACKGROUND OF THE INVENTION

1. Field of the Invention

The present invention generally relates to a book bag and in particular a book bag with removable interior wallet.

2. Background Description

Presently, general purpose book bags are designed to carry traditional books and supplies. Often these bags are designed to be carried on one's back as a backpack making easy access to contents difficult. These conventional book bags once filled typically exceed manageable size and often cannot fit into storage locations such as school lockers. These book bags typically provide no particular consideration for the presentation of material contained in the bag itself.

Furthermore, conventional book bags are not oriented to providing quick and convenient access to the actual subject material contained in the book bag. Learning materials such as books are not given consideration for easy access and direct referencing. Accessing a book held in a book bag requires that the book be removed from the book bag in order to read or use the book.

Therefore, a book bag with consideration to the material contained within it and a convenient way of accessing and reading the material within the book bag is needed. The book bag should also be conducive to educational learning practices and enhance the choices by which instruction to students is achieved.

SUMMARY OF THE INVENTION

It is another object of the invention to provide a wallet inside the book bag wherein the wallet is capable of storing separate pages of a book.

It is another object of the invention to provide a wallet inside the book bag so that the contents of the sleeves in the wallet are easily changeable.

It is still another object of the invention to provide a mechanism to attach and detach the wallet thereby providing a quick means of replacing subject material.

It is yet another objective of the invention to permit storage of common papers and books in addition to the wallet material.

It is still another objective of the invention to permit reading of the book without removing it from the book bag.

It is therefore an object of the invention to provide a book bag that is stylish and easy to carry.

According to the invention there is a book bag with a wallet compartment detachably coupled thereto. Releasing a retaining strap opens the book bag and unzipping the book bag exposes a top and bottom half of the wallet compartment. Multiple panels are bound together to form a wallet-style book. The panels are encased in transparent plastic sleeves on both sides. The sleeves can be accessed to remove and replace paper, photos, and the like. The wallet has connection means on its spine and is connectable to a mating connecting spine on the inside of the book bag.

Since the wallet constitutes a book is easily detachable, the subject matter in the book can be easily replaced by swapping wallets. In a school situation, an entire subject can be presented using this wallet-style book. New material or chapters can be quickly replaced. The book can also be opened and the pages, i.e., panels, read very similar in manner as a conventional book.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A DETAILED EMBODIMENT OF THE INVENTION

The present invention is directed to a book bag having a detachable insert or wallet that allows a user to easily access a book and, importantly, read the book while remaining within the book bag, itself. The book bag is an attractive way for children, for example middle school-aged girls and others, to transport readily accessible materials such as school study magazines and books.

Book Bag of Present Invention

Figure 1:
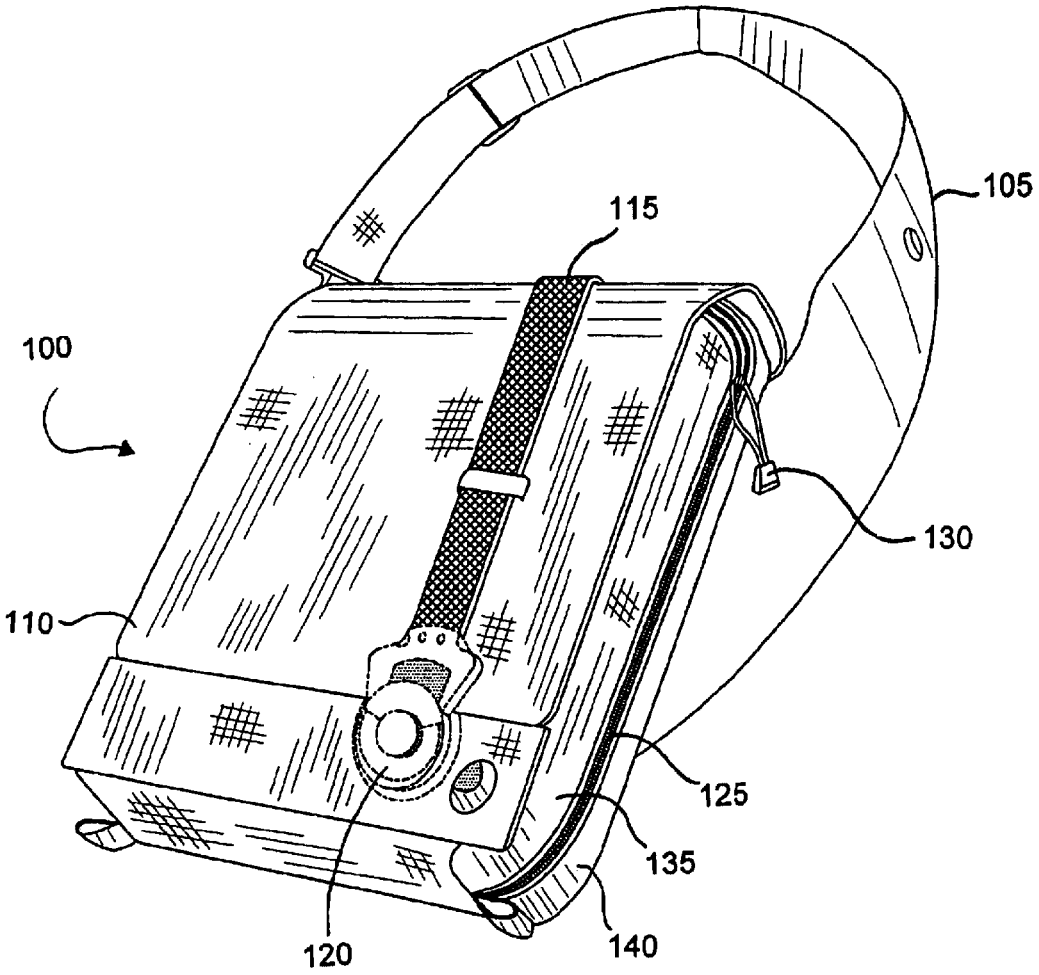
FIG. 1 shows a closed book bag with features according to the present invention.

FIG. 1 shows a closed book bag 100 with a detachable carrying strap 105. The strap 105 enables the book bag 100 to be carried over a shoulder in a fashion similar to a purse or computer carrying case. The outer covering material of book bag 100, in embodiments, can be courdura, vinyl, leather, fabric, plastic, or similar composition and may also contain a protective material such as foam that provides cushioning protection to the book bag contents. The book bag 100 may be in any color or blend or colors. An outer flap 110 is held in a closed position by a retaining strap 115. The outer flap 110 is preferably a continuous extension of the outer book bag material. However, it should be realized by those of ordinary skill in the art that the strap 110 may also be a separate feature.

Although the book bag of the present invention may be of any size, approximate preferred dimensions may comprise a height of 13 inches, length of 10¼ inches, and overall outer thickness of about 3½ inches.

A retaining strap latch mechanism 120 is attached to a distal end of the retaining strap 115 and may be of various types such as a buckle, snap, clasp, or a magnetic latching magnetorheological fluid base lock mechanism that provides a convenient and easy way to secure the book bag. The latch may be lockable for security reasons. The latch may be locked or unlocked, depending on the user's desire to access the interior portion of the book bag 100.

Figure 2:
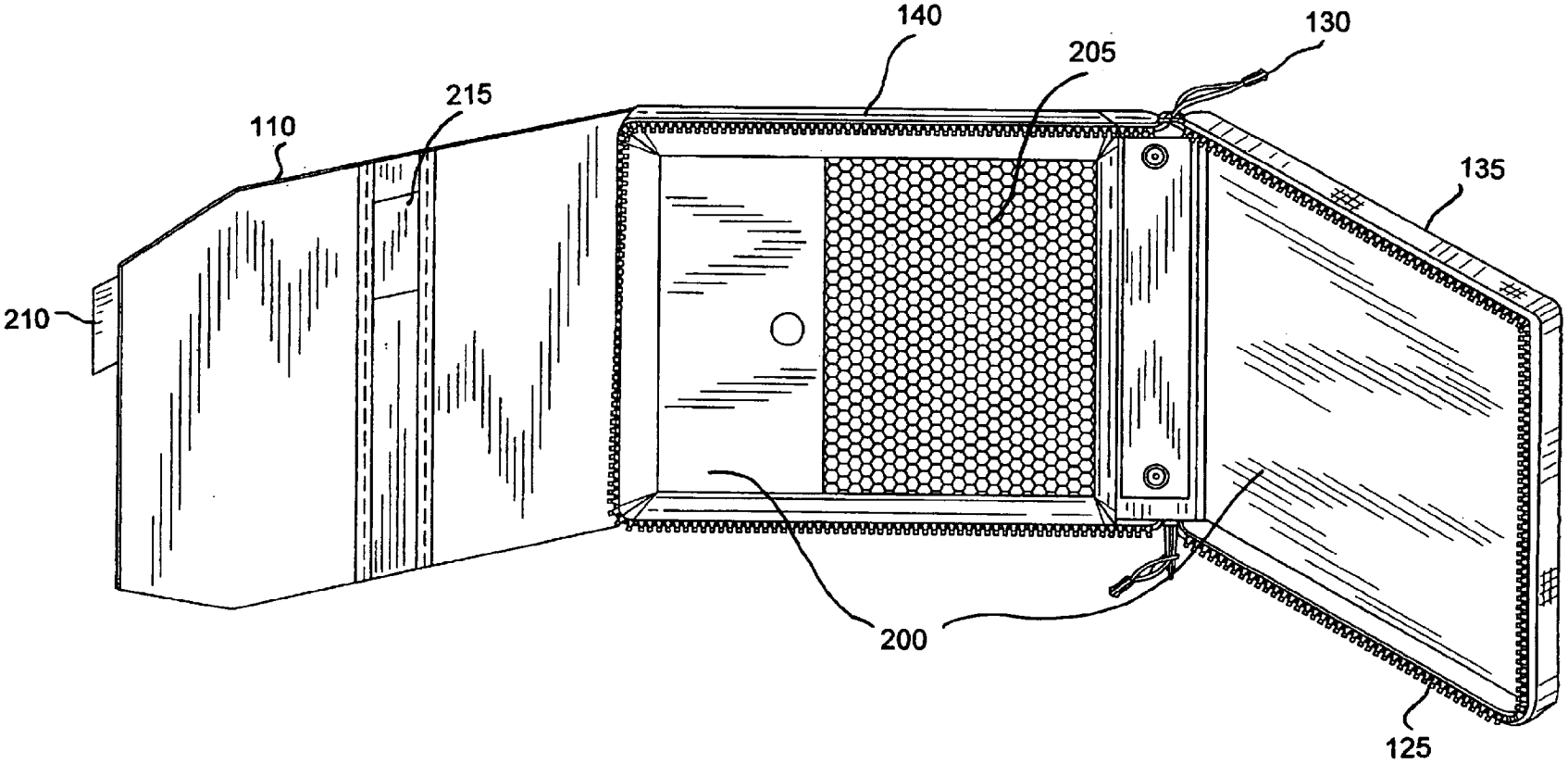
FIG. 2 shows of the book bag in an open condition without a carrying strap or wallet according to the present invention.

Referring now to FIG. 2, a fastener mechanism 125, preferably a zipper, is operated by pull 130 and mates a first compartment section 135 of a the book bag with a second compartment section 140 of the book bag on three sides. The compartment sections each have a base section with a supporting perimeter wall that forms a depth thereto. In the closed position, the first compartment section 135 and the second compartment section 140 forms an interior compartment, generally, depicted as reference numeral 200, of the book bag, 110.

The compartment 200 may stow a detachable wallet or wallets (shown in FIG. 3) when closed or open. An inner half of the first or second compartment section 140 may have a flexible mesh retainer 205 for holding papers, books, or other items. On an end of the outer flap 110, or other location, a message tab 210 for displaying a product message such as, for example, a slogan or brand name may be provided. The message tab 210 is preferably an integral part of the outer flap 110; however, this message tab 310 may also be a separate unit. Also, on the inside of the outer flap 110 is a nameplate 215 for use by the book bag owner or user to record identification information. The outer flap material may be an extension of the book bag outer material.

Figure 3:
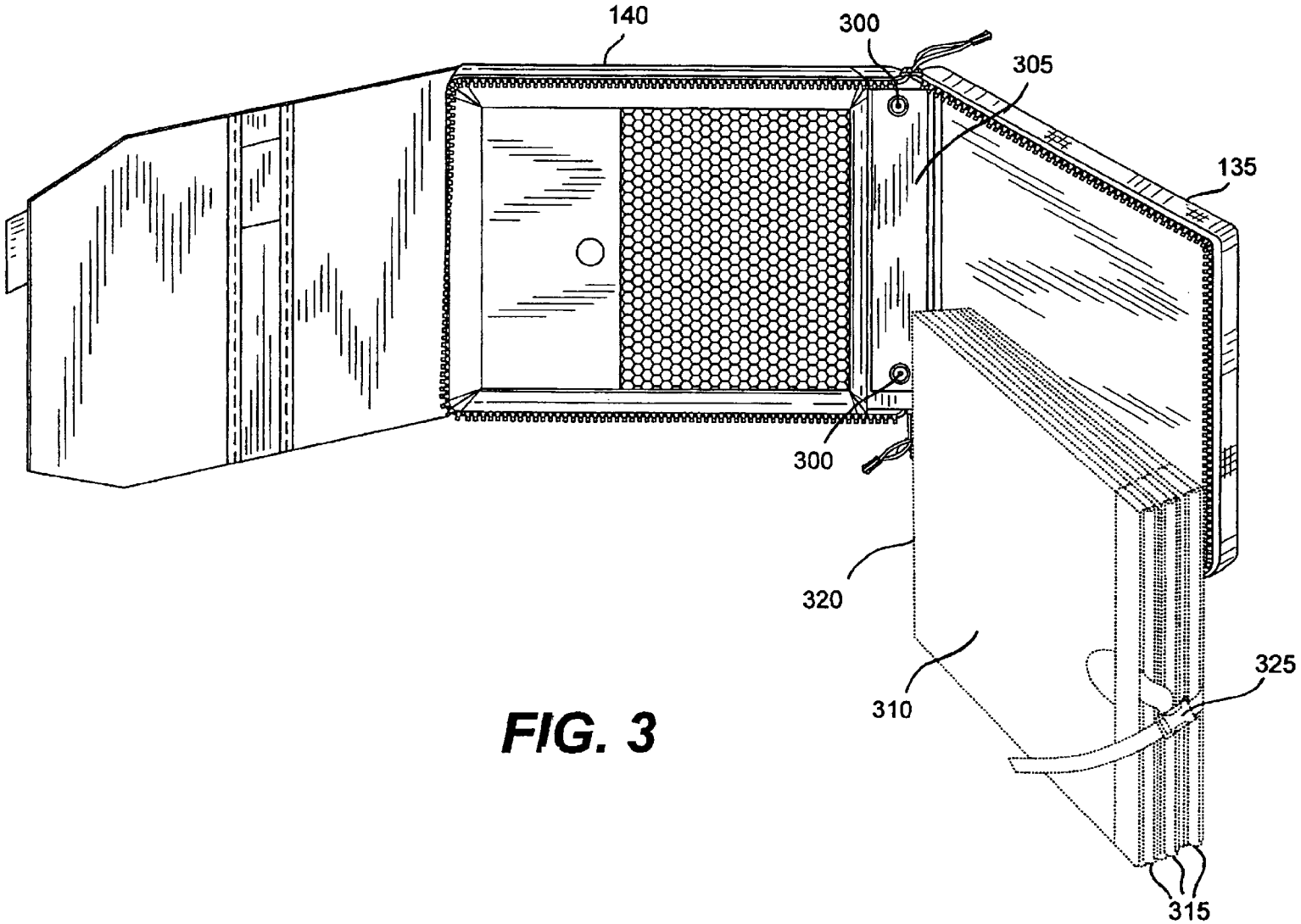
FIG. 3 shows the book bag with a detached wallet and without a carrying strap according to the present invention.

FIG. 3 shows a wallet connecting mechanism 300, which in embodiments is a substantially rigid connecting spine 305. The spine provides a mechanism for mating and attaching a detachable wallet 310 to the interior portion of the book bag. The wallet connecting mechanism for attaching and detaching of the wallet 310 may be, in embodiments, snap connectors, a hook and claw connector such as Velcro® (Velcro® is a registered trademark of Velcro Industries), connecting straps, slip hooks, and the like. The connecting spine 305 is, in embodiments, integral to the book bag construction and creates a strong and durable hinge plate when the book bag is opened or closed and when viewing material in the wallet 310. It is conceivable that the wallet 310 is also permanently attached at the spine 305. More than one wallet may also be attached, coupled or otherwise connected to the book bag.

The detachable wallet 310 is made of multiple rigid or semi-rigid panels 315 bound together at its base end 320 in a flexible manner to permit opening of the panels 315 in a manner similar to pages in a book. The panels can be made of any one of various materials such as styrene, cardboard, acrylonitrile butadiene styrene (ABS), and the like, but preferably polyvinyl chloride (PVC). The panels typically are about ⅛ inch thick depending on the material employed, but can be more or less. A latching strap 325 such as a slip strap, Velcro® strap, or the like, holds together or releases the multiple panels for viewing as necessary. Typical number of panels may be from six to ten, but any number may be utilized and the length and height of the wallet is related to the overall dimension of the book bag and the wallet compartment 200. The wallet is dimensioned so that it is slightly smaller that the height and width of the wallet compartment. The wallet or wallets are approximately 2¼ inches thick when fully utilized, but can vary. In general, the only limitation as to the size and shape of the wallet 310, itself, is the dimensions of the interior compartment 200 of the book bag.

Figure 4:
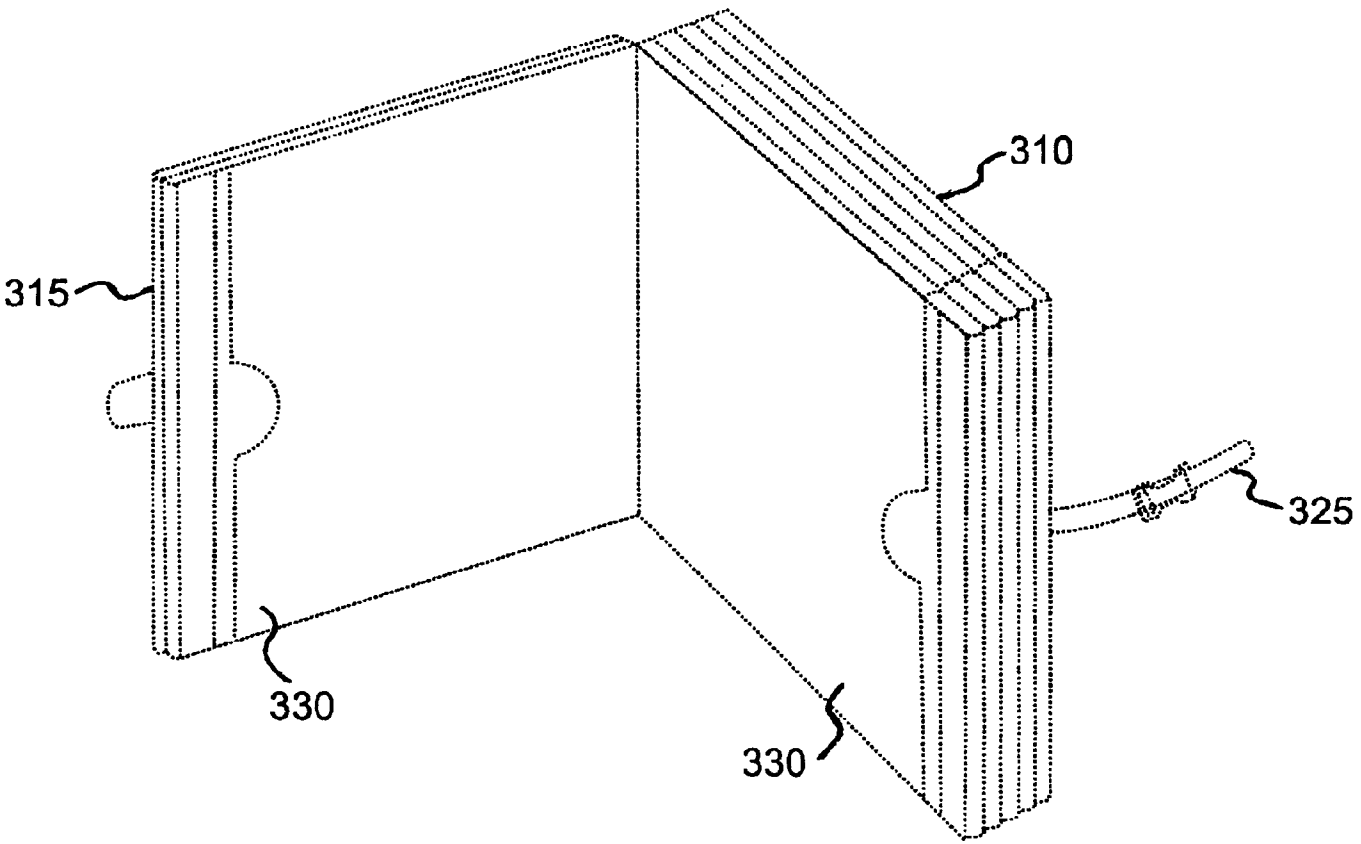
FIG. 4 shows an open wallet including panels and sleeves according to the present invention.

FIG. 4 shows the wallet 310 in an open position for viewing contents stored therein. The wallet 310 includes panels 315 encapsulated with transparent plastic sleeves 330, with the sleeves 330 preferably on both sides of each panel. Subject material or pages can be slipped into the sleeves 330 as necessary for viewing. It is now possible to create wallets that are tailored to a particular subject matter and an entire course of study can now be presented and entirely contained within a wallet 310. Additionally, it is now possible to create pages of information such as photographs or special material including graphs, drawings, or data sheets for a comprehensive and methodical study or reference of a particular subject. The panels can be turned and read in a manner similar to a book. In this manner, a book or other material can now be read and studied without the need to remove such book or other material from the sleeves 330. This provides for an easier manner to present materials.

Figure 5:
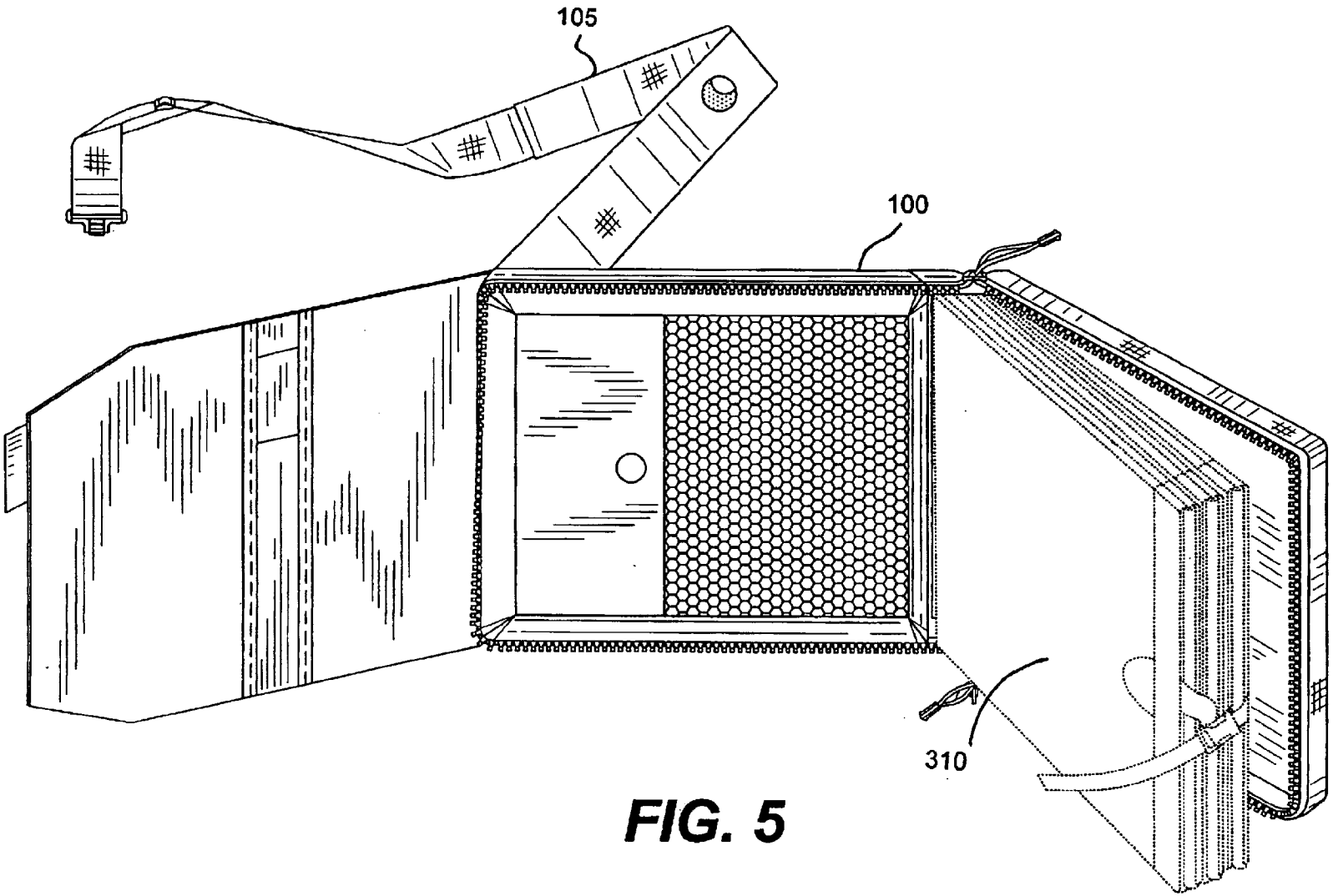
FIG. 5 shows the book bag with the wallet attached and carrying strap detached at one end according to the present invention.

FIG. 5 shows the book bag 100 open with the carrying strap 105 detached at one end. The wallet 310 is shown as attached to the book bag 100 with wallet panels 315 closed.

Method of Using Present Invention

Since the wallet is detachable, new contents can be exchanged quickly. Students, for example, could be given new material prepared by a teacher simply by replacing the wallet. Teachers are now able to prepare wallets beforehand and exchange the wallets during class, or students can update the contents as necessary.

The book bag essentially becomes a book when opened for reference and can be read as if it were a conventional book. New subject matter is added by either changing the contents of one or more sleeves or the entire wallet can be exchanged for a new wallet of lesser or greater number of panels as necessary.

Unlatching the retaining strap and releasing the fastening mechanism (e.g., zipper) opens a book bag. The wallet panels can be turned for viewing or browsing by the user as desired.

Replacing a wallet involves removing the wallet from the spine and reattaching the wallet with a different or same wallet.

Updating material in the wallet involves opening a sleeve and removing any material in the sleeve and re-inserting new material into the sleeve.

Closing the book bag involves stowing the wallet in the interior compartment, closing the fastening mechanism (e.g., zipper) then latching the retaining strap.

Other materials may be carried in the book bag and the book bag may be carried using the carrying strap.

While the invention has been described in terms of preferred embodiments, those skilled in the art will recognize that the invention can be practiced with modifications and in the spirit and scope of the appended claims.

Having thus described our invention, what we claim as new and desire by Letters Patent is as follows:

1. A book bag for carrying and storing information, comprising a first compartment section;

a second compartment section;

a fastening mechanism for mating the first compartment section and the second compartment section creating an interior wallet compartment;

a connection between the first and second compartment sections; and a wallet detachably coupled to the connection and adapted to being stowed in the interior wallet compartment when the book bag is closed or opened, the wallet including sleeves for storing and viewing individual pages of the information, the panels of the wallet are flexibly bound together at one end, each of the panels are encapsulated with transparent plastic sleeves for holding the individual pages of the information, wherein the wallet further comprises a latching strap for holding the multiple panels together.

2. The book bag according to claim 1, further comprising a means for attaching and detaching the wallet to the connection.

3. The book bag according to claim 2, wherein the attaching and detaching means is a snap connector.

4. The book bag according to claim 1, wherein the connection is a substantially rigid spine integrally formed between the first and second compartments.

5. The book bag according to claim 1, further comprising:

an outer flap formed over one of the first or second compartments;

a latchable retaining strap for holding the outer flap in a closed position; and a latching mechanism for latching the latchable retaining strap to one of the first or second compartments.

6. The book bag according to claim 5, wherein the latching mechanism is one of a buckle, a snap, a clasp, and a magnetorheological fluid base lock mechanism.

7. The book bag according to claim 5, wherein the outer flap includes at least one of a name plate for recording identification and a message tab for recording a product message.

8. The book bag according to claim 1, further comprising a carrying strap connected to one of the first compartment, second compartment and the fastening mechanism.

9. The book bag according to claim 1, further comprising outer material including one of fabric, vinyl, leather, and plastic.

10. The book bag according to claim 9, wherein the fabric is courdura.

11. The book bag according to claim 1, wherein each of the said multiple panels is made from one of acrylonitrile butadiene styrene (ABS), polyvinyl chloride (PVC), plastic, and styrene.

12. The book bag according to claim 1, wherein the fastening mechanism comprises a zipper.

13. A book bag for carrying and storing information, comprising a first compartment section having a base section and a perimeter wall providing a first depth;

a second compartment section having a base section and a perimeter wall providing a second depth;

a fastening mechanism for mating the first compartment section and the second compartment section creating an interior wallet compartment;

a spine connecting the first and second compartment sections; and a wallet detachably coupled to the spine and stowed in the interior wallet compartment when the book bag is closed or opened, the wallet including individual sleeves for storing and viewing individual pages of the information, wherein panels of the wallet are flexibly bound together at one end, each of the panels are encapsulated with transparent plastic sleeves for holding the individual pages of the information and the wallet further comprises a latching strap for holding the multiple panels together.

14. The book bag according to claim 13, further comprising an attaching and detaching mechanism for attaching and detaching the wallet.

15. The book bag according to claim 13, further comprising:

an outer flap formed over one of the first or second compartments;

a retaining strap for holding the outer flap in a closed position; and a latching mechanism for latching the latchable retaining strap to one of the first or second compartments.

* * * * *